United States Patent [19]

Hasty

[11] Patent Number: 4,953,247

[45] Date of Patent: Sep. 4, 1990

[54] AIR-OPERATED BODY SUPPORT DEVICE

[76] Inventor: Charles E. Hasty, Box 185, Carrollton, Tex. 75006

[21] Appl. No.: 335,945

[22] Filed: Apr. 13, 1989

Related U.S. Application Data

[63] Continuation-in-part of Ser. No. 192,583, May 9, 1988.

[51] Int. Cl.[5] ..... A61G 7/057

[52] U.S. Cl. ..... 5/453; 5/455; 137/625.66; 137/625.68

[58] Field of Search ..... 5/453, 455, 459, 423, 5/449, 456; 137/625.68, 625.66

[56] References Cited

U.S. PATENT DOCUMENTS

| | | | |
|---|---|---|---|
| 3,822,425 | 7/1974 | Scales | 5/453 |
| 3,909,858 | 10/1975 | Ducker | 5/453 |
| 4,099,276 | 7/1978 | Hunt et al. . | |
| 4,488,322 | 12/1984 | Hunt et al. | 5/453 |
| 4,525,885 | 7/1985 | Hunt et al. | 5/453 |
| 4,638,519 | 1/1987 | Hess | 5/453 |

FOREIGN PATENT DOCUMENTS

| | | | |
|---|---|---|---|
| 8606624 | 11/1986 | PCT Int'l Appl. | 5/453 |

OTHER PUBLICATIONS

Clinitron Brochure (SSI Inc. 4349 Corporate Rd., Charleston, S.C. 29405).

Monarch Brochure (Mediscus, Inc. 6700 East Pacific Coast Hway., Long Beach, Calif. 90803.

Flexicair Brochure SSI Inc. 4349 Corporate Rd., Charleston, S.C. 29405.

KinAir Brochure KCI Inc. P.O. Box 8588, San Antonio, Texas 78208.

Dr. Vokner's Lamellar Turning Bed Brochure, Jan Stahl GmbH, Elmshorn/Hamburg, W. Germany.

Pegasus Brochure Dermalex Co. Ltd.

*Primary Examiner*—Alexander Grosz

*Attorney, Agent, or Firm*—Ross, Howison, Clapp & Korn

[57] ABSTRACT

Airtight sacks are installed in parallel array to support a patient. A blower supplies air to the sacks through a function control valve system and a multi-tap high flow pressure selector. The pressure selector defines discrete zones of air pressure between its inlet and its exhaust to atmosphere. An adjustable tap communicating with individual sacks or group of sacks may be selectively placed in communication with any of the pressure zones to independently establish the pressure maintained in the corresponding sacks. The sacks may be connected to the line from the pressure tap at a single valve. The slide valve has one state permitting communication between the blower and the sacks, a second state sealing all sacks and third state venting all sacks. A detector and indicator of the patient's depth of deflection is provided for at least one sack. The blower may be used also to operate adjunctive air devices such as air pillow overlays for imparting desired movement to a patient.

6 Claims, 5 Drawing Sheets

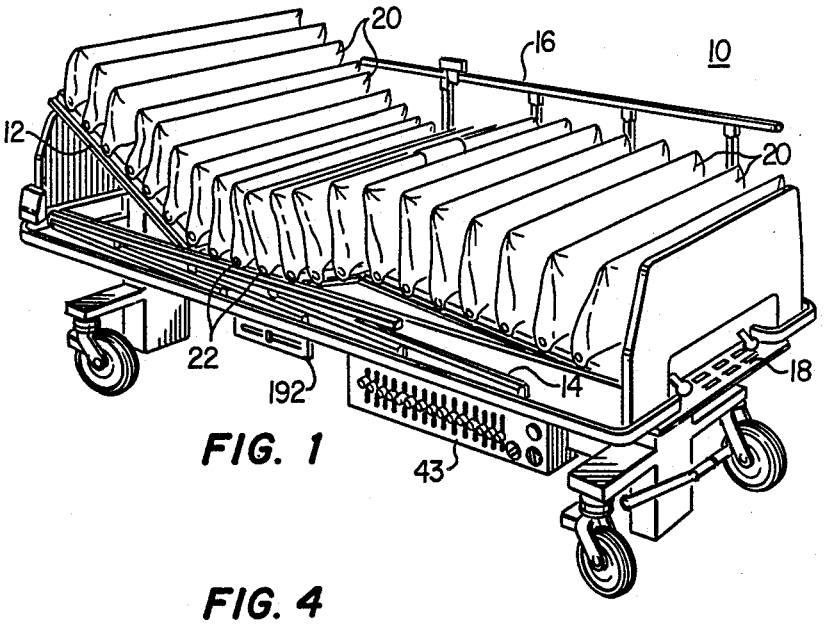
FIG. 1
FIG. 4
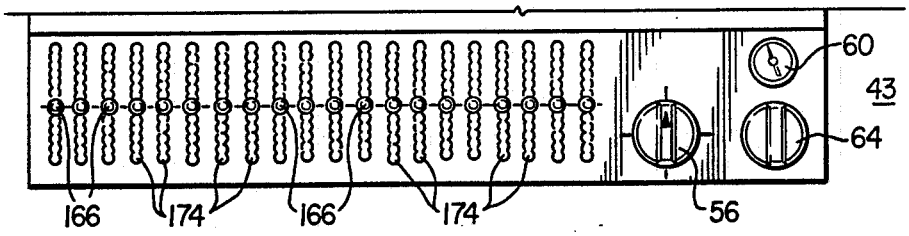
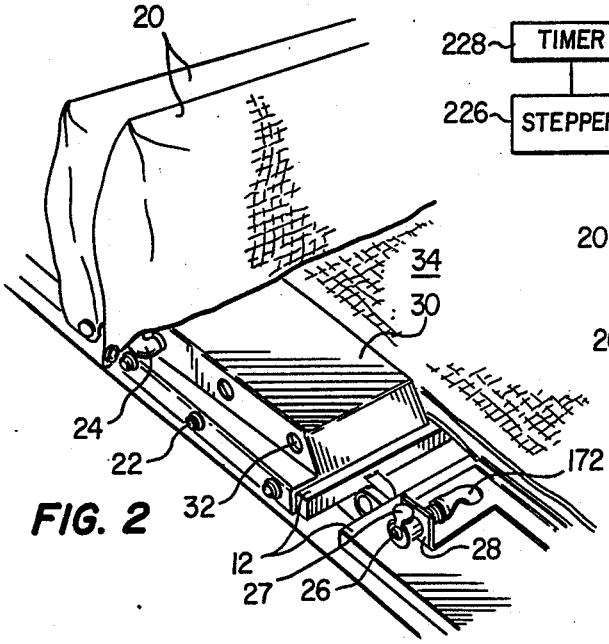
FIG. 2
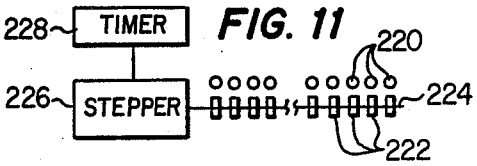
FIG. 11
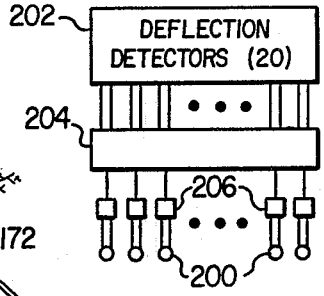
FIG. 10

| | NOR | CPR | MAX | TRAN |
|---|---|---|---|---|
| 44 | O | X | O | X |
| 46 | X | O | X | X |
| 48 | O | X | O | X |
| 50 | X | O | X | X |
| 52 | O | X | X | X |

AIR-OPERATED BODY SUPPORT DEVICE

CROSS-REFERENCE TO RELATED APPLICATION

This application is a continuation-in-part of Ser. No. 07/192,583, filed May 9, 1988, also entitled "Air-Operated Body Support Device".

FIELD OF THE INVENTION

This invention relates to body support devices utilizing inflatable air sacks, and has particular application to hospital beds for patients at risk to pressure sores.

BACKGROUND OF THE INVENTION

Much attention has been directed for many years to the design of reduced pressure patient support systems for maximizing patient comfort and reducing the risks of pressure sores in bedridden patients. One of the early widely used therapies in this field was a floatation system marketed under the trademark "CLINATRON." This device is a large tub containing an air permeable sack filled with micron-sized silicon spheres. The spheres are formed into a fluidized bed by massive introduction of air into the bottom of the tub. This device marked the early stages of hospital rental equipment for patients at risk because of skin grafts, burns or pressure sores. The equipment was bulky and weighed almost one thousand pounds. An extremely large blower was required to effectuate the system, and any tears in the sack containing the silicon spheres could cause spheres to be blown out around the area of the apparatus. Despite its problems, and the great expense associated with utilization of the equipment, it has been widely used for patients at risk from excessive bed pressure.

In more recent years, a class of devices has been introduced which the industry has come to designate as "low air loss". A typical low air loss support system has a plurality of upstanding parallel vapor-permeable air sacks inflated to provide support for the patient. Such devices are marketed under the trademarks "Monarch," "Air Plus," "Flexicair," and "Kin Air". The approach of this class of equipment is to provide gradual leakage of air from the sacks, either by perforating them at selected locations or by providing a "breathable" sack material which is permeable to the passage of vapor. Typically, air is pumped from a manifold on one side of the bed through the sacks extending transversely of the bed. The air is wholly or partially exhausted through holes or pores in the sacks and at least in some instances, through an exhaust port. The air losses necessitate the use of a rather large air pump or blower, and the systems constructed of this type tend to be bulky and expensive. To seek to avoid infection problems stemming from the holes or open pores of the sack material, special sterilization precautions are necessary. Some of these commercial beds are provided with special sack configurations to impart desired movements to the patient. The beds are not easily adaptable to acute care hospital use and are not radiolucent so as to permit taking X-rays of a patient lying in one. This class of beds includes permanent electrical circuitry making its use unacceptable in certain hospital environments. Because of their air loss characteristic, these beds cannot support the patient when blower operation is terminated. Thus, if the patient is to be transported to another hospital area, the sacks will be deflated unless battery power backup is provided. Despite their deficiencies, these beds have grown to dominate the market, which is predominantly served by the temporary leasing of these special purpose beds to hospitals as required for particular patients, generally at a rate to the hospital of about $100.00 per day. For reference, U.S. patents issued to makers of such commercial beds include U.S. Pat. No.3,822,425, 3,909,858, 4,099,276, 4,488,322, 4,525,585 and 4,638,519.

Other simple approaches to providing reduced pressure patient support systems include water mattresses, air mattresses (including types with varying air pressure in alternating sections of the mattress) and "egg-crate" mattresses.

The utilization of the present invention is believed to present a substantial advance over the technology known in this industry. By providing essentially zero air-loss sacks in a system adapted to permit the clinician to carefully and quickly control the air pressure in all parts of the support system and to quickly carry out procedures required for care of the patient, the invention overcomes many of the problems of the art. The air sacks and electrical components of the system can quickly be installed or removed from a radiolucent intensive care bed. On removal, there are no electrical components remaining on the bed, and the bed may be utilized efficiently in acute care hospital use. Because the invention does not utilize air sacks with holes or permeable pores, problems of infection and sterilization are minimized. The no-air loss sack approach permits the utilization of a much more compact air flow source. The end result is a system which is lightweight and relatively simple and inexpensive. The bed may be transported without air pump operation while still maintaining air pressure in the sacks to support the patient. In one preferred embodiment, this "transport" mode isolates each sack, or selected adjacent groups of sacks such as sack pairs, from others so that the pressure profile established among the sacks by the clinician is preserved during the transport mode. This configuration also permits efficient use of the air blower, since the blower can be turned off for long periods of time by placing the apparatus in this sealed-off transport configuration. This may be particularly beneficial in providing economical use of beds of this type in the home environment. Because of the ability to preserve the support pressure profile without full use of the blower, the blower also can be used to drive adjunctive air devices useful in other aspects of patient therapy. For example, the blower may be used with adjunctive devices such as air pillow overlays for rolling the patient, and/or for flexing portions of the patient's body such as knees or feet.

The system is readily adaptable to automatic, time-varying rhythmic pressure variance therapies. It also may be adapted to automatic pressure control in feed back loops responsive to the weight and position of a patient.

SUMMARY OF THE INVENTION

In accordance with the invention, there is provided a body support device comprising a plurality of upstanding parallel elongated air sacks abutting to form a support surface, the material of the sacks being substantially impervious to the passage of air and other fluids. Each sack is provided with an inlet communicating with its interior, and all of the inlets are connected to an air flow production means to provide pressurized air to all of the sacks. Thus, each sack, in cooperation with the air flow production means, forms a support pressure system for the part of the person's body on the sack. Means are provided for selecting and establishing the pressure maintained in each sack or in individual groups of sacks such as adjacent sack pairs, and for closing the pressure support systems to retain air pressure in the sacks.

In a specific embodiment, there are provided valve means to permit rapid switching of connections between the air flow production means and the sacks from a first state in which the inlet of the air flow production means communicates with atmosphere and the outlet communicates with the sack inlets to pressurize the sacks, and a second state in which the intake of the air flow production means communicates with the sack inlets and the outlet is vented to atmosphere, so that rapid pump down of the device may be achieved by causing the valve means to move to the second state.

Devices constructed in accordance with the invention may also include means for sensing the distance that the top of one of the air sacks is supporting the patient above a reference point, thus sensing the depth of the patient's deflection of the sack to enable optimal setting of the system pressure level.

In one form of the invention, each sack is free of every other sack, so that it may be removed from the array, and there is provided check valve means associated with the bed adjacent the sack inlet which is operable on removal of the sack to stop the flow of air at the check valve.

The invention contemplates that the means for selecting and establishing the pressure maintained in the sacks may consist of a high flow conduit with an inlet connected to the outlet of the air flow production means. The conduit has discrete zones, each zone being maintained at a different pre-selected percentage of the inlet pressure. Means are provided for selectively connecting the inlet of each sack, or group of sacks, to a selected one of the zones.

Particularly adapted to the purpose of controlling the pressure in the sacks is a multi-tap pressure selector having an inlet connected to the air flow source and a first block on one face of the selector having a plurality of channels, one of which is connected to the inlet. A second block on the opposite face of the selector also has a plurality of channels. A tap block interposed between the first and second blocks has a plurality of restricted passageways, each of which interconnects a different pair of channels on opposite sides of the selector. Each restricted passageway produces a pressure drop between the two channels of its interconnected pair. The channels and restricted passageways form a continuous sealed air flow conduit leading from the inlet, with each channel defining a zone of discrete and unique pressure. A plurality of pressure taps are slidably positioned in the tap block, each of the taps communicating with a different sack or group of sacks. Each tap may be moved to selectively connect its air sack or air sack group to any one of the channels in the first and second block, and thus to any selected one of the discrete pressure zones. The selector has an outlet connected to one of the air flow channels at the end of said air flow conduit remote from the inlet.

In one embodiment, the invention incorporates a valve interposed between the pressure selector and the air sack inlets. The valve may be moved between a first state in which the sack inlets are open to fluid communication from the air flow source through the pressure selector, and a second state closing the sack inlets so that the pressure profile among the sacks established by the air flow source and the pressure selector when the valve is in the first state may be substantially preserved upon movement to the second state. In a particular form, the valve is a slide valve having a first surface in which air passages from the pressure selector terminate, and a confronting second surface on which the air sack inlets are arrayed, and the valve operates by relative sliding motion between the two valve surfaces. The valve may have a third state venting the sacks to atmosphere for deflation.

The invention also contemplates a valve which is biased to the state sealing the air sack inlets to preserve the pressure profile among the sacks, and an automatic valve actuator causing the valve to switch to the state connecting the sacks to the air flow source through a pressure selector only during times when the air pressure produced by the air flow source for use in the air sacks exceeds a threshold pressure.

A multimode system employs the invention for both supporting a patient on air sacks having a desired pressure profile and for intermittently causing movement of the patient. This system employs a single air flow source and at least one pressure selector, and a movement overlay removably positioned on the air sacks having a plurality of inflatable compartments, the inflation and deflation of which are adapted to cause selected movement of the patient. In this aspect, the invention includes flow control means for exposing air from the air flow source to the sack inlets and also for directing air into and from the compartments of the movement overlay to produce desired movements while preserving a desired pressure profile among the sacks.

The advantages of the invention can be appreciated more fully by reference to the enclosed drawings which depict embodiments of the invention in more detail.

BRIEF DESCRIPTION OF THE DRAWINGS

FIG. 1 is an overall perspective view of a hospital bed to which the invention has been applied;

FIG. 2 is a partial perspective view illustrating the connection of the air sacks to the bed of FIG. 1, with some sacks and one connector cover plate removed;

FIG. 4 is an elevation of the pressure and function control panel of the bed of FIG. 1;

FIG. 10, is a schematic diagram of an automatic deflection detection-pressure setting feedback loop which can be used on the type of bed illustrated in FIG. 1;

FIG. 11 is a schematic diagram of a time-varying rhythmic control system for use on the type of bed illustrated in FIG. 1;

DETAILED DESCRIPTION

Figure 3:
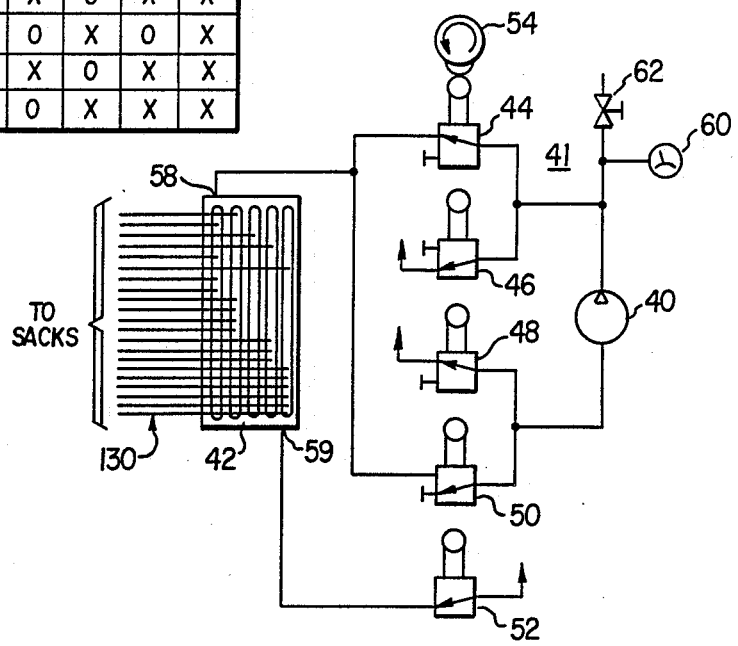
FIG. 3 is a schematic diagram of the air flow circuitry of the bed of FIG. 1, including function control valves and pressure selector.

A critical care hospital bed to which the invention has been applied is indicated by the reference numeral 10 in FIG. 1. Bed 10 includes a segmented platform 12 lying generally horizontally between folding side rails 14 and 16. The articulated segments of platform 12 are adjusted by a hydraulic system to various positions dictated by patient comfort or clinical considerations, including medical procedures to be carried out on the patient. The hydraulic adjustments are controlled by the clinician through a control panel 18 located at the foot of the bed. The bed is of a radiolucent character, minimizing elements extending through the central area of a vertical projection of the patient lying in the bed which would interfere with the taking of x-rays of the patient. A bed having the general characteristics thus far described, which is appropriate for application of this invention, is a critical care bed marketed by Humanetics, Inc. of Carrollton, Tex. under the trademark "CardioSystems".

As depicted in FIG. 1, the ordinary mattress of bed 10 has been removed and replaced by an array of twenty air sacks 20 forming part of a body support system in accordance with this invention. The support sacks 20 are fluid-tight, and are arranged in parallel array extending generally between the side rails 14 and 16. The sacks 20 are not perforated by sewing or any other means, so that the material's airtight characteristic is preserved. The sacks may be formed from any suitable impermeable material by heat sealing. One sack material preferred for the application of the invention is a nylon to the inside of which a heat sealable urethane coating is applied. Each sack 20 is independent and separate from every other sack in the array, so that it may be removed and/or replaced by itself. The sacks are held in position by a series of snaps 22 located along each side of platform 12.

As seen in FIG. 2, each sack is formed with an inlet 24 extending into the interior of the sack at one end thereof. An array of horizontally-oriented quick connection check valve couplings 26, each having a release lever 27, is spaced along the margin of the platform 12 in mounting brackets 28 adjacent to side rail 14, one corresponding to each of the sacks 20. The mating connector portion for the coupling is located on inlet 24 of each sack, so that each sack may be quickly provided with connection through a check valve to the air supply system of the bed described below. Check valve 26 and its complimentary connection portion associated with the inlet 24 may, for example, be the quick connect couplings marketed under the trade name "CPC" by Colter Products Company.

Only one check valve coupling 26 is illustrated in FIG. 2 for clarity of illustration, but the array of check valves corresponds on a one-to-one basis with the number of sacks provided in the system. A cover 30 is provided for each segment of platform 12 along the margin of the platform containing the check valve connectors 26. Cover 30 is provided with horizontal apertures 32 for access to each of the check valve connectors 26. Disconnection of sack inlet 24 from the check valve 26 may be quickly affected by raising inlet 24 to press lever 27 against the top of cover 30, releasing air sack 20 from the array and enabling the check valve 26 to stop all passage of air. Cover 30 minimizes the possibility of fluid spill interference with the connector's functioning.

In order to provide a level base for the sacks 20, and to provide some margin of comfort in the base of the bed at times when the support system is not functional, a foam pad 34 approximately equal to the height of cover 30 covers the remainder of platform 12. A conventional comforter (not shown) may be placed over the air sacks to promote evaporation of perspiration or other liquids, and to help manage problems created by incontinence.

FIG. 3 schematically illustrates the manner in which support sacks 20 are interconnected in a system in accordance with the invention to provide easily controlled support for the body. The major operative elements of the system are an airflow production source such as air pump or blower 40, a function control valve system 41, a high flow multi-tap pressure selector 42, and the array of support sacks 20.

The function control valve system 41 and pressure selector 42 are, as will be seen, compact units which can be installed underneath bed platform 12 along one edge of the bed behind control panel 43. Blower 40 may be very compact and placed in a portable box (not shown) to be removably hung under the bed and connected to the function control valve system 41. A suitable method of connection is by a quick disconnect arrangement of sliding confronting plates having a pair of ports on each plate. The ports on the box are associated with the inlet and outlet of the blower 40, and are matched to the two ports communicating with system 41. System 41 includes five on/off valves, 44, 46, 48, 50, and 52. Valves 44–52 may be operated by a single control shaft carrying a series of five cams such as the one indicated at numeral 54, to operate the valves between their on and off positions. The cams 54 may be controlled by the clinician utilizing function control knob 56 on the control panel 43, shown in FIG. 4, to turn this shaft. Although cam operation of the valves is a convenient and simple one for construction and use, other valve activation mechanisms may be employed, including solenoids. Valve 44 blocks or enables communication between the positive or outlet side of pump 40 and inlet 58 of the pressure selector 42. Valve 46 gates the connection between the pump outlet and atmosphere. Valve 48 provides on/off connection between the negative side or inlet of pump 40 and atmosphere. Valve 50 is also connected to the inlet of pump 40, and provides on/off communication with the inlet 58 of selector 42. Valve 52 simply permits connection of the outlet 59 of selector 42 to atmosphere. Function control system 41 also includes a pressure gauge 60 and a bleed valve 62 permitting the outlet side of pump 40 to be selectively bled to atmosphere by the setting of weight selection knob 64 located on control panel 43 as shown in FIG. 4. This setting establishes the pressure at selector inlet 58.

Figure 5:
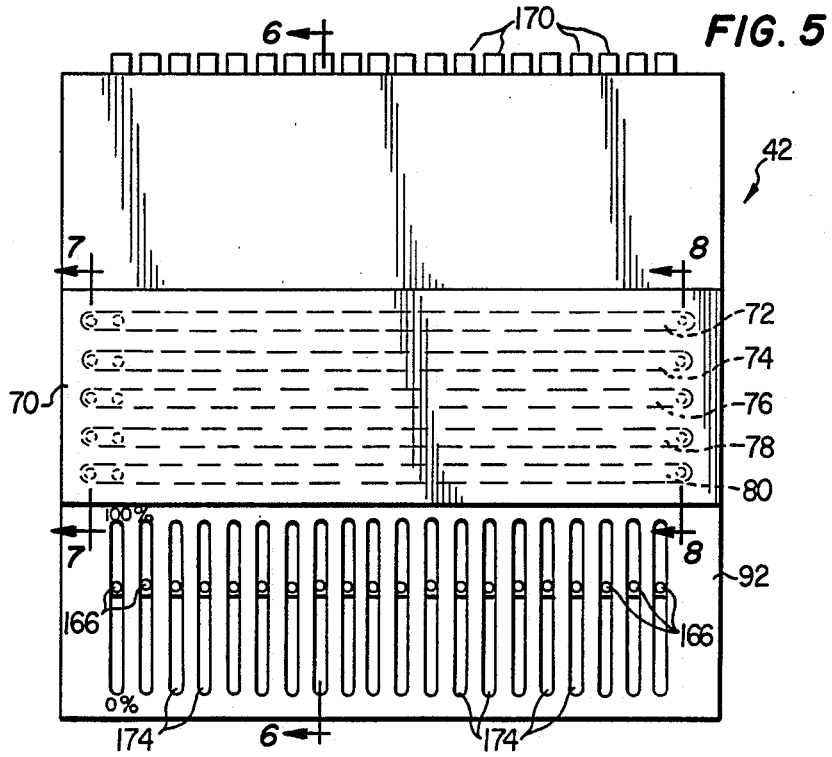
FIG. 5 is an elevation illustrating the high flow multi-tap pressure selector of the bed of FIG. 1.
Figure 6:
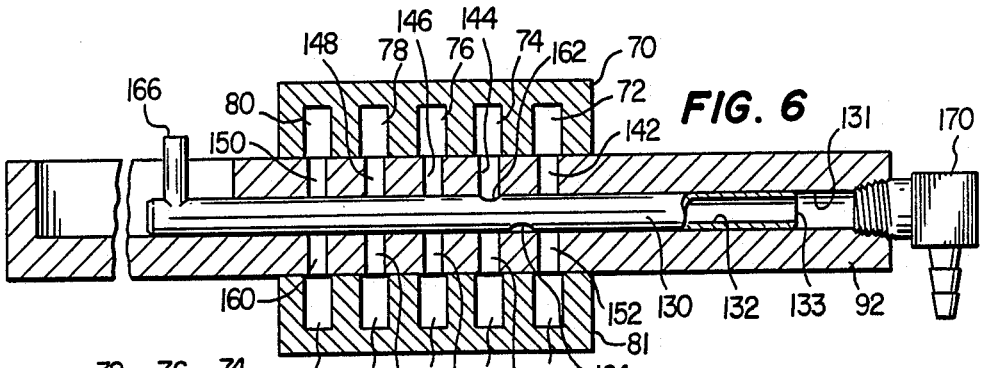
FIG. 6 is a sectional view along line 6—6 in FIG. 5.
Figure 7:
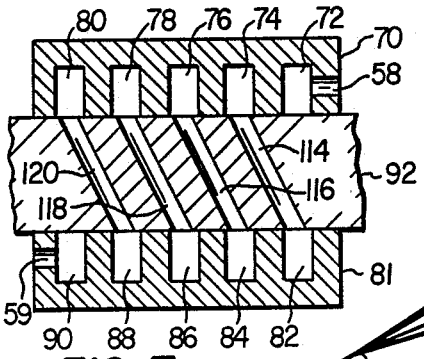
FIG. 7 is a sectional view along line 7—7 in FIG. 5.

The structure and operation of pressure selector 42 is best understood in conjunction with FIGS. 5–7. Selector 42 includes a front block 70 having a series of channels 72, 74, 76, 78 and 80 formed in the rear face thereof. Channel 72 is the high pressure entrance plenum communicating with selector inlet 58. A rear block 81 is formed substantially identically to the front block 70. Channels 82, 84, 86, 88 and 90 formed in the face of block 81 confront, but are spaced from, the channels 72–80 of block 70. Interposed between block 70 and block 81 is a tap block 92 which is sealingly engaged with blocks 70 and 81 by suitable means such as gaskets (not shown).

Figure 8:
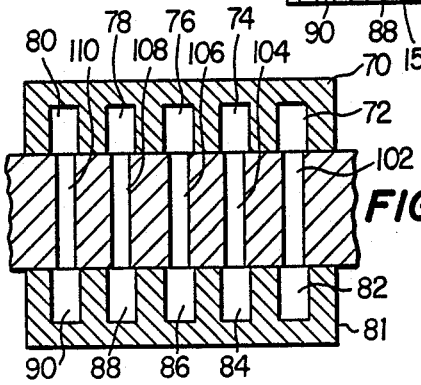
FIG. 8 is a sectional view along line 8—8 in FIG. 5.

Channel 72, which communicates with selector inlet 58 at one end thereof (FIG. 7), communicates at the opposite end (FIG. 8) through restricted passageway 102 with its corresponding channel 82 in the rear block 81. Likewise, at that same end, as seen in FIG. 8, channels 74 and 84 are connected by restricted passageway 104; channels 76 and 86 are connected by restricted passageway 106; channels 78 and 88 are connected by restricted passageway 108; and channels 80 and 90 are connected by restricted passageway 110. The ends of certain channels of the first and second blocks 70 and 81 are also interconnected at section 7—7 by slanted passageways, as indicated in FIG. 7. Restricted passageway 114 connects channels 82 and 74; restricted passageway 116 connects channels 84 and 76; restricted passageway 118 connects channel 86 to channel 78; and restricted passageway 120 passes between channel 88 and channel 80. The end of channel 90 at the cross-section taken in FIG. 7 communicates in turn with outlet 59 from the selector 42. It will be appreciated that the circuitry thus defined in blocks 70 and 81 together with the tap block 92, is a sealed airflow conduit extending from the selector inlet 58 to outlet 59. The conduit passes through the length of each channel 72–90 in series, with a restricted passageway providing communication across tap block 92 between each channel in the series. Each restricted passageway, by its restricted size in comparison to the flow cross-section of the channels themselves, provides a pressure drop between each of the ten sections of the flow conduit. Thus, each of the ten channels defines a unique pressure which is a preselected percentage of the inlet pressure, with pressures declining from channel 72 to channel 90. A suitable restriction size is established depending on the desired balance between two competing characteristics: (1) smaller size will increase the maximum pressure available to the system; and (2) larger size will increase flow rates and thus decrease the time required to inflate or deflate the sacks.

The pressure zones defined in the channels of blocks 70 and 81 may be communicated with individual ones of the air sacks 20 by means of a series of pressure taps 130 carried in shafts 131 in tap block 92. A tap 130 and shaft 131 are provided to correspond with each sack 20. A representative tap 130 and shaft 131 are shown in FIG. 6. Tap 130 is formed with a bore 132 extending through the tap from its upper end 133. The shaft 131 may be sealed toward its top and bottom by O-rings (not shown). A series of tapping ports communicates between each shaft 131 and each channel of blocks 70 and 81. Shaft 131 is connected to channels 72, 74, 76, 78, 80, 82, 84, 86, 88 and 90 by tapping ports 142, 144, 146, 148, 150, 152, 154, 156, 158 and 160, respectively. An orifice 162 is formed in the wall of tap 160 facing the series of tap ports 152–160. A second orifice 164 in the opposite side of tap 130 faces the series of tap ports 142–150. Orifices 162 and 164 are on diametrically opposed sides of the tap 130, and are axially spaced from one another by one-half the distance between adjacent tapping ports in the series 142–150 or 152–160. In this way, as any tap 130 is axially moved, the user may expose the central bore 132 of that tap for communication with any one of the ten channels defined in blocks 70 and 81. In the apparatus depicted, manual movement is enabled by horizontally extending lever 166 located near the lower end of tap 130. Each tapping shaft 131 communicates adjacent end 133 of tap 130 to a fitting 170. Fitting 170 of each tap is connected by hose 172 to one of the check valves 26 mounted on the bed platform 12. Thus, there is one-to-one correspondence of taps 120 to sacks 20. Alternatively, each tap may be connected to the inlets of an adjacent pair of sacks, an arrangement which reduces the number of taps and other parts required, and thus makes fabrication more economical.

Reference is now made to the valve position table illustrated in FIG. 3. The control shaft 54 has four different positions defining different combinations of open and closed states for the five valves 44–52. These combinations are shown in the table. In normal operation, valves 44, 48 and 52 are open, while valves 46 and 50 are closed. Air is taken into the pump through open valve 48, and pumped to selector inlet 58 via open valve 44. It passes through the 10 pressure zones of the selector 42 and out open valve 52. Each tap 130 is adjusted to cause its corresponding sack to maintain the pressure of a selected one of the zones. Individual adjustment of pressure in one sack by manipulating one of the taps 130 has no long term effects on the pressure of the other sacks and only minimal transient effects.

A second functional position of control shaft 54 is a rapid pump down or deflation of the air sacks 20 denominated as "CPR", as rapid deflation may be desired for the emergency administration of CPR. In this functional setting, each of the valves assumes the opposite state from that which it maintains during normal setting, so that the pump positively pumps down the sacks. The third functional setting is maximum inflate, which is to rapidly fill all of the air sacks in the system. This may be desired simply to set up the system or may be called for by radiographic procedures. In this functional setting, all valves except for valve 52 are in their normal operational state. On maximum inflate, valve 52 closes the exhaust port 59 from selector 42. Finally, the fourth functional setting is the transportation mode, which implies the cessation of airflow production in the system. In this mode, all valves are closed to preserve air pressure in the sacks. In the three non-normal function settings, it is possible that the blower could be run air-starved. Suitable protection to prevent harm to the blower, as by a time or temperature cut-off or relief valve, may be provided.

Referring to FIG. 4, it can be seen that a readily understandable control panel 43 is mounted on one side of the bed in front of selector 42 and function control system 41. The left hand portion of the panel includes the twenty individual tap levers 166 mounted for vertical sliding movement to produce the axial movement of each tap 130. By manual adjustment of each lever, each individual air sack may be communicated to a different one of the pressure zones in pressure selector 42. Preferably, the tracks 174 guiding levers 166 are provided with ten detent positions corresponding to each of the ten axial positions of each tap.

At the right end of panel 43, the function control knob 56 permits the clinician to place the system into any one of the four functional modes. Pressure gauge 60 reflects the pressure generated at the outlet of the pump, as regulated by the setting of bleed valve 62.

Figure 9:
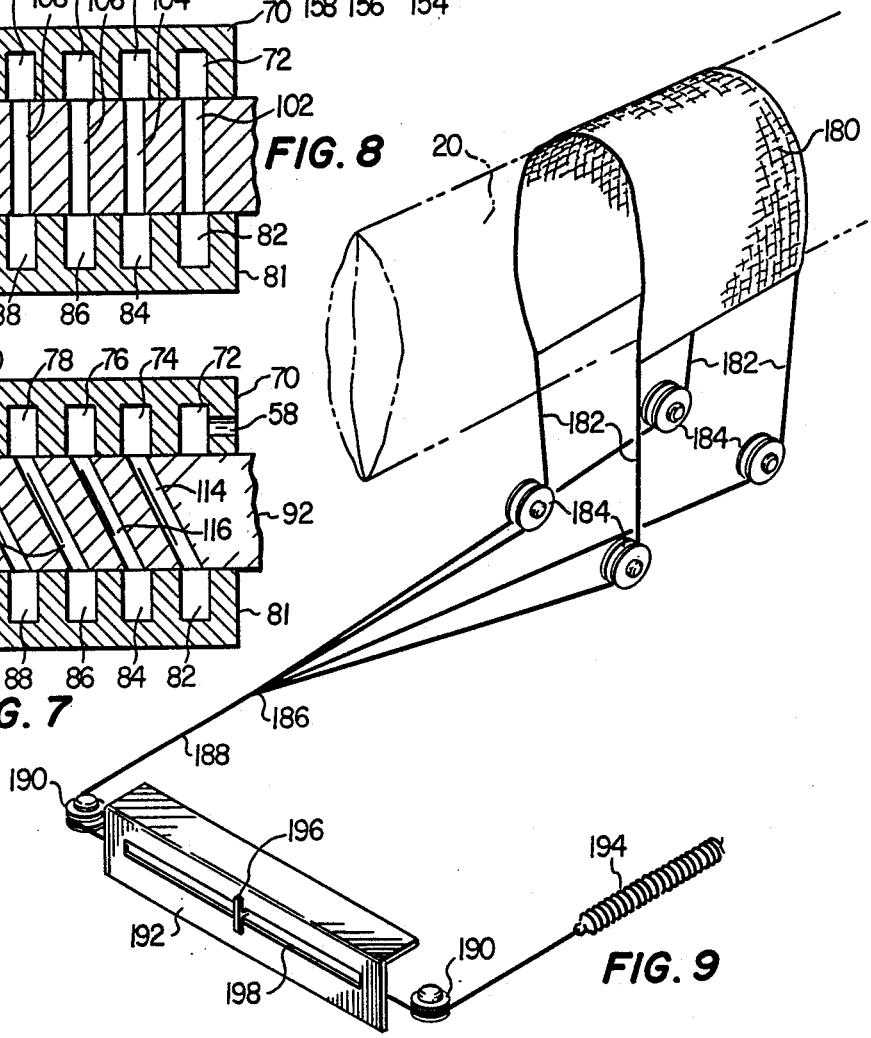
FIG. 9 is a schematic view of the deflection depth indicator of the bed of FIG. 1.

The setting of weight selector 64 to control bleed valve 62 is further enabled by the deflection indicator system schematically illustrated in FIG. 9. A central sack 20 in the array is provided with a rectangular sheet 180 stretched across its upper surface. Four cords 182 extend downwardly from sheet 180 over pulleys 184 to a common point of joinder 186 to cord 188. The common cord 188 is guided by indicator pulleys 190 behind an indicator scale 192 mounted on the side of the bed. Tension is provided to cords 182 and 188, to hold sheet 180 firmly to the sack 20, by spring 194. Cord 188 carries a pointer 196 which slides in a slot 198 in scale 192. This guides the clinician in adjusting the overall system pressure by turning weight selection knob 64 to change the setting of bleed valve 62. The adjustment is made until the pointer 196 is in the central range of scale 192, indicating sufficient pressure to maintain the patient well above the platform 12, but sufficient softness to enjoy the benefits of low pressure support.

Of course, for any given air pressure in the sacks, a heavier person will sink deeper in the sacks than a lighter one. Little or no penetration would mean that the weight of the patient is being supported by a minimum contact area, maximizing contact pressure. By reducing air sack pressure and permitting the contact area to increase, the contact pressure is reduced. Eventually, the contact area is maximized by pressure reduction, and further pressure reduction will produce no additional benefit. The scale 192 and pointer 196 should be aligned so that the central range of indication is in the zone of maximized contact area.

While adjustment of pressure at selector inlet 56 by adjusting weight selector knob 64 has been illustrated to effect proper patient depression of the sacks, other structural techniques may be used. For example, by providing valves 44–52 with continuous adjustment capability between their "on" and "off" states, and by modifying cam 54, the bleed valve 62 can be eliminated and the adjustment be performed by manipulation of the function selector knob 56 in a range around the normal function setting. The cams 54 would be configured to gradually move valves 44–52 between their normal functional states and their opposite states as the knob 56 is turned from "normal" to "CPR". This gradually reduces the pressure at selector inlet 58. The cam 54 controlling valve 52 would gradually increase the restriction of valve 52, as knob 56 moves from "normal" to "maximum", thus increasing the pressure at 58.

Other forms of detecting and indicating the depth of the patient's deflection may be used. For example, an ultrasonic emitter/sender may be mounted below a sack 20 in the center of platform 12. Reflected energy signals returning to the platform 12 can be detected to ascertain the depth of the patient's depression of the top of the sack. Such a system producing electrical data signals could be used in a feedback loop to automatically control the overall system pressure, as by adjusting bleed valve 62.

The system of this invention is readily adapted to automatic pressure control modalities. A multiple feedback control system for the individual pressure taps is schematically illustrated in FIG. 10. The individual pressure taps 200 are set in response to signals from individual deflection detectors 202 mounted with each sack, such as ultrasonic emitter/sensors described above. The signals from each detector 202 are sent individually to a processor 204 which controls individual stepper 206 for adjusting each tap 200. Each signal is continuously compared by processor 204 to a desired valve for the particular sack, and any error signal generated causes the processor to activate the particular stepper 206 corresponding to the detector causing the signal. Stepper 206 moves tap 200 in a direction to minimize the error signal.

Although this multiple feed-back system is optimally operated on deflection signals, it will be appreciated that individual sack pressures could be sensed to produce the error signals. The pressure to be maintained in a sack to produce the desired range of deflection, however, will vary from patient to patient. A pressure sensing system should have as its base line desired pressure a value which is established after observing the patient in position.

This invention may also be utilized in a system for producing time-varying rhythmic pressure therapies, as schematically illustrated in FIG. 11. Rhythmic variation in pressures, with each individual sack passing through a range of available pressure with the passage of time, is often desired and can be easily accomplished by the system of this invention. Taps 220 are adjusted by individual cams 222 on cam shaft 224 driven by stepper 226 under the control of timer 228. By selection of cam shape and timing of stepper commands, the clinician can vary the pressures in individual portions of the bed as desired.

It will be appreciated from the foregoing description that many benefits and advantages flow from application of this invention to the hospital environment. Adjustment of the pressure taps gives a quick way of establishing the desired firmness or softness in each supporting sack. Adjustment of one tap does not cause variations in the pressure of other sacks. The system can be quickly switched from normal function to rapid deflation or pump-down. The device can be deprived of its air flow operation and still support the patient with an air cushion. The elimination of passage of air or other vapor through the sacks reduces the risks of infection and simplifies cleaning and sterilization. The fastening of sacks to bed is done with connectors concealed from the hazards of fluid spills. The sack connectors permit removal of any sack without compromising the integrity of the air circuit.

The sacks and blower box may be readily removed to permit use as an ordinary bed, eliminating the necessity for a single use rental bed which is costly and of limited versatility. The air flow circuitry components are compact and do not compromise the radiolucent characteristics of the bed. The system is adaptable to automatic control of pressures including control in response to deflection detection as well as time-varying rhythmic pressure adjustment.

Figure 12:
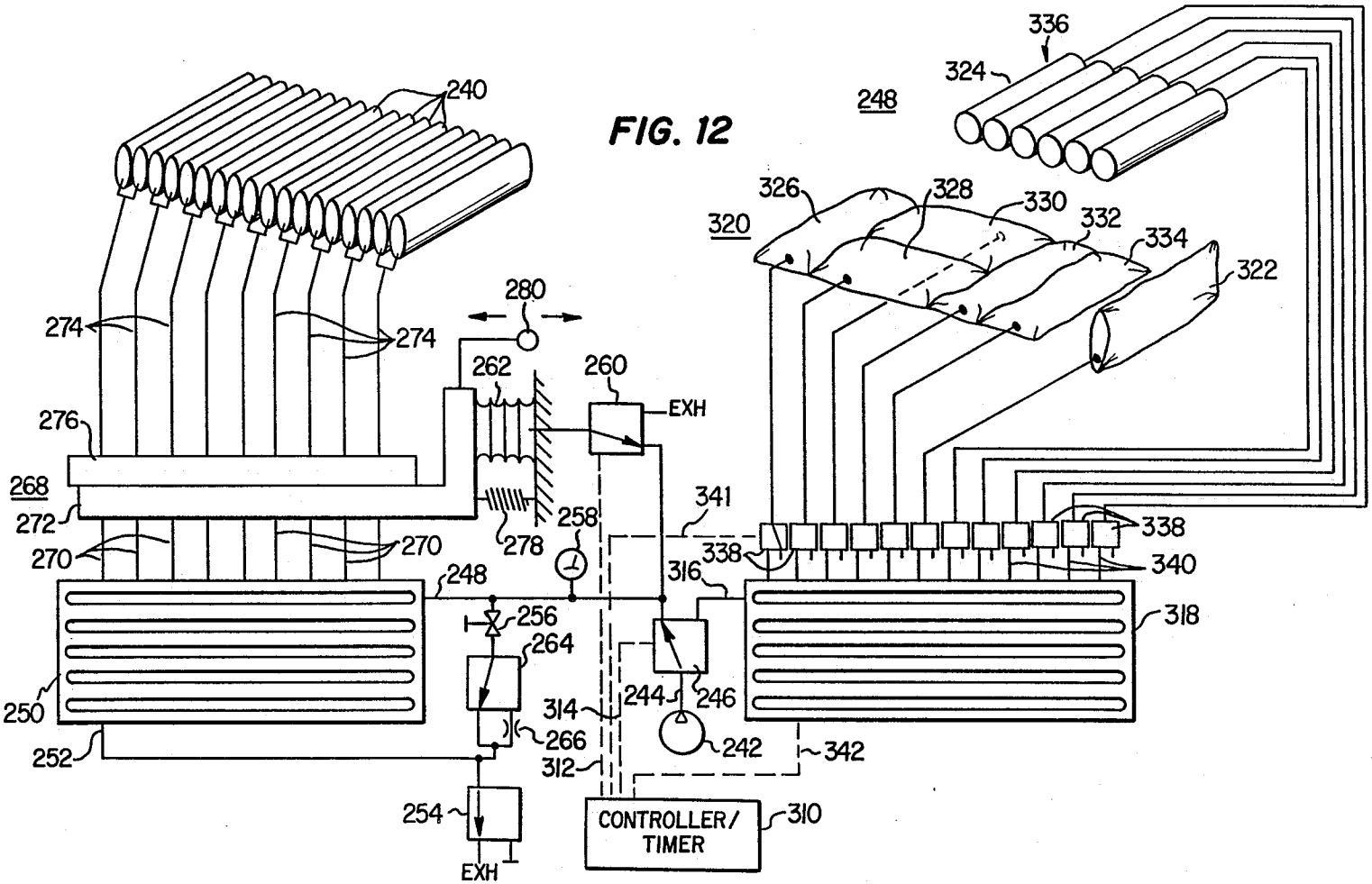
FIG. 12 is a schematic diagram illustrating another embodiment of the invention.

A preferred system embodying the invention, employing a slide valve connecting pressure selector taps to air sacks, and enabling multiple uses of a single blower, is illustrated in FIG. 12. As depicted in FIG. 12, an array of air-tight support sacks 240 is connected to an air flow source such as a blower or air pump 242 which provides the pressurized air to inflate the sacks at selectable pressures to provide a support pressure profile desired by the clinician. The output 244 of air flow source 242 is alternatively directed by two position valve 246 to the system for supplying the air sacks 240 or to a patient movement overlay system 248, which will be described in more detail below. In the position illustrated in FIG. 12, the output of the blower air pump 242 is connected by valve 246 to the air supply system for air sacks 240. Air is supplied to the inlet 248 of a high-flow pressure selector 250. Pressure selector 250 is constructed, as described above in detail in connection with FIGS. 4–8, to define zones of distinct pressure which are predetermined percentages of the maximum pressure at inlet 248. The outlet 252 of selector 250 extends through two position maximum inflate valve 254. Valve 254, in its normal setting depicted in FIG. 12, simply exhausts the output, but may be moved to a closed position for rapid inflation of sacks 240 at startup.

The maximum pressure of selector 250 in operation may be optimized by the user by means of weight control valve 256 operated in conjunction with pressure gauge 258. Weight control valve 256 and gauge 258 correspond to similar elements indicated by the reference numerals 60 and 62 in FIG. 4. Their operation may be assisted by one or more deflection detectors such as described in conjunction with FIG. 9.

The output of blower 242 may also be connected through valve 260 to a closed air bellows 262 which will be described in more detail below. A Fowler boost valve 264 is also placed in parallel with pressure selector 250. Valve 264 has a normal setting depicted in FIG. 12 and a second setting which directs the output of valve 264 through a restricted orifice 266 for increasing the air pressure at selector inlet 248 by approximately fifty percent. This conveniently permits the operator to quickly increase the pressures in the pressure zones of selector 250, and thus in the air sacks 240 by approximately fifty percent, to facilitate positioning the patient in an upright sitting position in the bed, which requires higher sack pressures.

A slide valve 268 provides the interface between pressure selector 250 and the air sacks 240. The pressure selector taps 270 extending from pressure selector 250 are connected to a sliding valve member 272 in valve 268. The inlet lines 274, each extending from an adjacent sack pair, connect to the stationary member 276 of valve 268. Valve 268 operates by relative sliding motion of the confronting surfaces of members 272 and 276 between three discrete positions. The first is a normal position, in the middle setting of slide valve 268, which connects each pressure tap 270 to a corresponding sack pair inlet 274. When the valve member 272 is moved to the right as shown in FIG. 12, the sack pair inlets 274 are all sealed against the confronting face of member 272, so that the pressure in sacks 240 is maintained in substantially the profile set by the user prior to movement to this transport mode. The third position of valve 268 is the "CPR" mode in which the sack pair inlets 274 are aligned with vent ports in member 272 so that the sacks 240 are vented to atmosphere, permitting their deflation.

Valve 268 is biased into the transport mode, in which each sack pair is isolated from the remainder of the system, by biasing spring 278. Manual selection of the positions of valve 268 may be made by one or more control levers such as depicted at 280 in FIG. 12. Automatic movement of the valve from the transport mode into the normal mode, connecting the pressure selector taps 270 to the sack pairs 274, is effected by bellows 262 upon its inflation by pump 242.

Figures 13, 14:
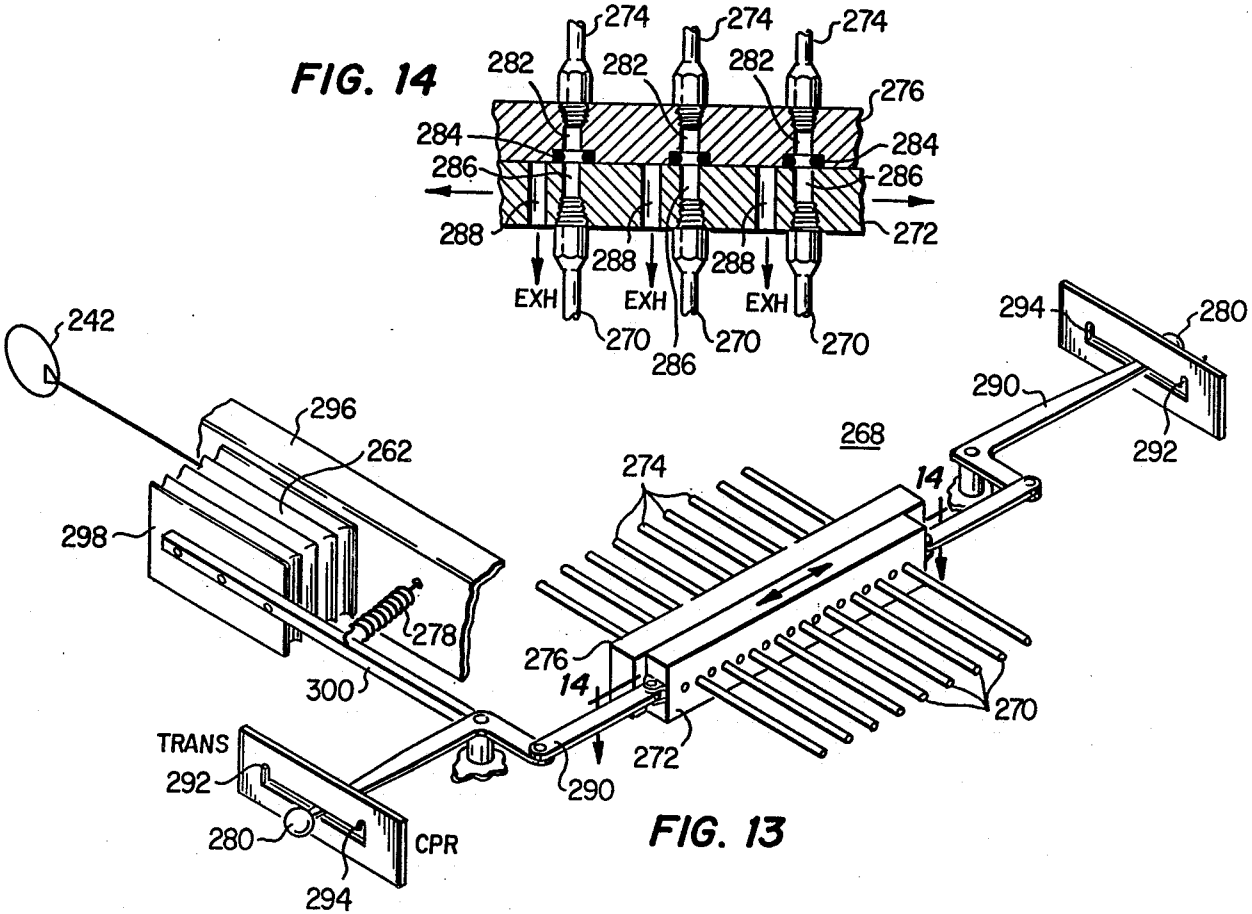
FIG. 13 is a perspective view illustrating a valve arrangement for use in the embodiment of FIG. 12.
FIG. 14 is a cross-section, broken away, taken along the line 14—14 in FIG. 13.

Construction of a suitable slide valve 268 is illustrated in more detail in FIGS. 13 and 14. In these figures, movement of sliding valve member 272 to the left produces the transport mode, while movement to the right gives the vented CPR mode. Stationary valve member is provided with a spaced array of passages 282 passing completely therethrough. Each of passages 282 is connected on the outer side of valve 268 to an inlet line 274, each of which communicates with a pair of support sacks 240. Sealing O-rings 284 surround each passage 282 at the surface of stationary valve member 276 confronting sliding valve member 272. A spaced array of corresponding passages 286 is formed through sliding valve 272 corresponding exactly to passages 282 of stationary valve member 276. These passages 286 are connected on their outside to pressure selector tap lines 270. In FIG. 14, the valve 268 is shown in its normal operating position, with the passages 282 and 286 aligned to communicate the air pressure from each tap 270 to its corresponding air sack pair 240. In this way, the pressure provided by the setting of each tap 270 is communicated to its corresponding sack pair to establish a pressure profile among the sacks as desired by the clinician. An equal number of vent ports 288 are provided through sliding valve member 272 just to the left of each passage 286. By movement of sliding valve member 272 to the right into the "CPR" position, all sacks are vented to atmosphere through the vent ports 288. Movement of sliding valve 272 to the left creates the "transport" made, blocking off the proximal ends of passages 282 so that the sacks are sealed and each sack pair is isolated from every other sack pair.

As depicted in FIG. 13, the valve 268 may be positioned transversely of the bed so that control knobs 280 may be provided for manual movement of the valve among its three states from either side of the bed. Knobs 280 are secured to suitable levers 290 for effecting the sliding movement of member 272. Detents 292 and 294 are provided for the extreme positions of valve 268, being the transport and CPR modes, respectively.

The automatic valve actuator bellows 262 is positioned against a stationary portion of the bed structure 296. Upon its inflation, bellows 262 exerts a force upon actuating paddle 298 connected by lever arm 300 the valve actuating lever 290. Biasing spring 278 connected between lever arm 300 and stationary structure 296 biases valve 268 through lever arm 300 and lever 290 to the transport mode. When air from the pump 242 inflates the bellows 262, automatic movement of valve 268 into the normal mode is effected. Upon any cessation of operation of the blower 242, the bellows pressure will be depleted and valve 268 will automatically return to the transport mode, sealing the individual support sack pairs.

As depicted in FIG. 12, the entire operation may be controlled through a central controller/timer 310. Controller 310 communicates with valve 260 through line 312, so that the automatic actuating bellows 262 may be disabled by moving valve 260 to its exhaust position, disconnecting bellows 262 from the air supply. Controller 310 also controls system selector valve 246 through line 314. The air supply system may be converted by controller 310 to periodic activation of the movement overlay system 248, either by manual selection or by automatic time cycling. When activation of the movement overlay system 248 is desired, valve 260 is first moved to the exhaust position so that the support sacks 240 are locked into their sealed transport mode to preserve the pressure profile established by the clinician among the array of air sacks. Then, valve 246 is switched over so that blower 242 is supplying its output through line 316 to the movement overlay pressure selector 318.

The overlay system 248 employs one or more inexpensive air mattress overlays. As depicted in FIG. 12, three overlays used on top of the support sack array may be used, either individually or all at once. The first, overlay 320, effects side to side roll or positioning of the patient's body as well as providing for knee flexure. Overlay 322 may be positioned against a moveable foot board to produce foot flexing. Overlay 324 provides a plurality of small volume sacks for lower leg stimulation.

Overlay 320 is divided into five separate air compartments. Pillow compartment 326 extends across one end of overlay 320. Immediately below the pillow 326 are two side-by-side roll compartments 328 and 330. At the lower end of overlay 320 are two transverse leg flexure compartments 332 and 334. The foot flexure overlay 322 includes a single compartment to be placed between the patient's feet and a vertical board such as a moveable foot board. Lower leg stimulation overlay 324 includes a plurality of transverse compartments 336.

Each of the compartments of overlay 320, 322 and 324 is connected through a two position valve 338 to a path leading from a selected zone of the pressure selector 318 through a pressure tap 340. Controller 310, via line 314, can alternate the valves 338 between venting the compartment and connecting it to its corresponding pressure tap 340. Controller 310 may also control, via line 342, the pressure setting of each tap 340.

Thus, with the system supplying air to line 316, any selected periodic inflation or deflation of the compartments of overlays 320, 322 and 324 may be effected. Roll compartments 328 and 330 may be utilized to position the patient on the bed. With compartments 328 and 330 deflated, no bias to the patient is provided. By inflating either of these compartments, the patient may be rolled to one side or the other. Flexing of the patient's legs may be affected by periodic inflation of compartments 332 and 334. The patient's foot may be flexed by inflation and deflation of compartments 322. A periodic ripple or wave through the compartment 336 of lower leg stimulation overlay 324 may be effected to advantageously stimulate circulation.

Rather than time share the blower by alternating selection of positions of valve 246, it is within the scope of this invention to simultaneously operate a support sack array 240 and overlay system 248. If the air movement demands of a selected overlay are small, this may be achieved by singly adding additional taps to selector 250 to drive the overlay. Otherwise, it may be accomplished by dividing the air output of blower 242 to drive both systems simultaneously. Even when use of an overlay is not desired, the isolation of air sack pairs in the transport mode permits the blower to be turned off for the majority of the time of operation. The blower need be turned on only briefly at infrequent intervals to insure maintenance of the desired pressure profiles.

Although specific embodiments of the invention have been illustrated in the accompanying drawings and described in the foregoing detailed description, it will be understood that the invention is not limited to the embodiments disclosed, but is capable of numerous rearrangements, modifications and substitutions of parts and elements without departing from the spirit of the invention.

I claim:

1. An air-operated support apparatus for a patient comprising:

(a) a plurality of adjacent air sacks formed of a material substantially impervious to the passage of fluids, each sack having an inlet tube;

(b) an air flow source for producing a stream of forced air;

(c) a pressure selector communicating with the sacks and the air flow source for selectively maintaining a desired profile of air pressure among the sacks;

(d) a single valve between the pressure selector and the air sack inlets movable between at least two states: a first state in which the sack inlets are open to fluid communication from the air flow source through the pressure selector; and a second state in which the sack inlets are closed, whereby the pressure profile among the sacks established by the air flow source and pressure selector when the valve is in the first state may be substantially preserved upon movement to the second state.

2. The apparatus of claim 1, wherein the valve has biasing means biased to the second state and an air-pressure responsive actuator is provided for moving the valve into the first state while the air pressure produced by the air flow source for use in the air sacks exceeds a threshold pressure.

3. The apparatus of claim 1 further comprised of a plurality of air passages, each air passage corresponding to selected ones of said sacks and extending from the pressure selector toward its air sack inlets, each such air passage terminating at a valve end; the valve including a first valve surface on which the valve ends of all such air passages are arrayed, and a second valve surface on which the air sack inlets are arrayed confronting the first valve surface, said valve operating by causing relative sliding motion between the first and second valve surfaces.

4. The apparatus of claim 3, wherein the valve includes vent ports opened to atmosphere in the first valve surface, and the valve may be moved to a third state aligning the vent ports with the sack inlets to cause deflation of the sacks.

5. The apparatus of claim 1, wherein the valve may be moved manually between said first and second states.

6. In an air-operated support apparatus for a patient which includes a plurality of air-tight sacks with inlets, an air flow source and a pressure selector for setting the pressure maintained in the sacks by the air flow source, the improvement comprising:

a valve connected between the pressure selector and the sacks, movable between a first state in which the sack inlets are open to fluid communication between the air flow source and the sacks through the pressure selector and a second state in which the sack inlets are closed;

biasing means biasing the valve to the second state; and an automatic valve actuator which causes the valve to switch to its first state only during times when the air pressure produced by the air flow source for use in the air sacks exceeds a threshold pressure.

* * * * *